US010384912B2

(12) United States Patent
Watanabe

(10) Patent No.: US 10,384,912 B2
(45) Date of Patent: Aug. 20, 2019

(54) MACHINE BASE ATTACHMENT DEVICE FOR ELEVATOR HOISTING MACHINE

(71) Applicant: MITSUBISHI ELECTRIC CORPORATION, Chiyoda-ku (JP)

(72) Inventor: Yasuo Watanabe, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 267 days.

(21) Appl. No.: 15/318,393

(22) PCT Filed: Aug. 13, 2014

(86) PCT No.: PCT/JP2014/071389
§ 371 (c)(1),
(2) Date: Dec. 13, 2016

(87) PCT Pub. No.: WO2016/024347
PCT Pub. Date: Feb. 18, 2016

(65) Prior Publication Data

US 2017/0121151 A1 May 4, 2017

(51) Int. Cl.
*B66B 11/00* (2006.01)
*B66B 7/02* (2006.01)
(Continued)

(52) U.S. Cl.
CPC ..... *B66B 11/0045* (2013.01); *B66B 7/02* (2013.01); *B66B 9/00* (2013.01); *B66B 11/04* (2013.01); *B66B 11/08* (2013.01)

(58) Field of Classification Search
CPC ..... B66B 11/0045; B66B 7/02; B66B 9/00; B66B 11/04; B66B 11/08
See application file for complete search history.

(56) References Cited

U.S. PATENT DOCUMENTS 4,577,729 A * 3/1986 Karol ..... B66B 7/024 187/408
5,520,264 A * 5/1996 Korhonen ..... B66B 7/02 187/408

(Continued)

FOREIGN PATENT DOCUMENTS

CN 1430574 A 7/2003
DE 10 2005 060 838 B3 3/2007

(Continued)

OTHER PUBLICATIONS

International Search Report dated Oct. 28, 2014 in PCT/JP2014/071389 filed Aug. 13, 2014.

(Continued)

*Primary Examiner* — Michael A Riegelman
(74) *Attorney, Agent, or Firm* — Xsensus, LLP

(57) ABSTRACT

A machine base attachment device for an elevator hoisting machine includes a reinforcing body attached to a forming rail that guides movement of an elevating body, and a machine base fixing member that is fixed to a machine base for supporting a hoisting machine, and attached to the forming rail. The forming rail includes a pair of flange portions and a rail projecting portion fixed between the pair of flange portions. A groove portion that opens between the pair of flange portions is formed in the rail projecting portion. The reinforcing body includes an insertion portion that is inserted into the groove portion. The machine base fixing member is attached to a part of the rail projecting portion in which the insertion portion is inserted.

8 Claims, 7 Drawing Sheets

(51) Int. Cl.

| | |
|---|---|
| ***B66B 11/04*** | (2006.01) |
| ***B66B 9/00*** | (2006.01) |
| ***B66B 11/08*** | (2006.01) |

(56) References Cited

U.S. PATENT DOCUMENTS

| | | | | |
|---|---|---|---|---|
| 5,673,771 | A * | 10/1997 | Rivera | B66B 7/022 104/106 |
| 6,230,844 | B1 * | 5/2001 | Latorre | B66B 11/0446 187/254 |
| 6,991,070 | B1 * | 1/2006 | Sanz Gamboa | B66B 7/02 187/406 |
| 8,657,075 | B2 * | 2/2014 | Sanz Gamboa | B66B 7/022 104/127 |
| 10,017,356 | B2 * | 7/2018 | Hubbard | B66B 7/022 |
| 2003/0121727 | A1 * | 7/2003 | Adifon | B66B 7/02 187/240 |
| 2005/0217943 | A1 * | 10/2005 | Heggli | B66B 7/021 187/266 |
| 2005/0269162 | A1 | 12/2005 | Higashi | |
| 2008/0011558 | A1 * | 1/2008 | Lusquinos | B66B 7/022 187/406 |
| 2008/0135345 | A1 * | 6/2008 | Kocher | B66B 5/18 187/351 |
| 2011/0186387 | A1 * | 8/2011 | Schwendenmann | B66B 7/025 187/408 |
| 2013/0056310 | A1 * | 3/2013 | Bjorni | B66B 7/022 187/359 |
| 2014/0238783 | A1 * | 8/2014 | Hubbard | B66B 7/02 187/406 |
| 2017/0008733 | A1 * | 1/2017 | Fernandez | B66B 7/022 |
| 2017/0036889 | A1 * | 2/2017 | Ericson | B66B 7/025 |
| 2017/0225926 | A1 * | 8/2017 | Watanabe | B66B 11/043 |

FOREIGN PATENT DOCUMENTS

| | | | |
|---|---|---|---|
| EP | 1 405 813 | A1 | 4/2004 |
| EP | 2 067 734 | A1 | 6/2009 |
| JP | 57 126376 | A | 8/1982 |
| JP | 59-108684 | A | 6/1984 |
| JP | 10-87223 | A | 4/1998 |
| JP | 11-31 4870 | A | 11/1999 |
| JP | 11-314870 | A | 11/1999 |
| JP | 2002-154758 | A | 5/2002 |
| JP | WO 2002/079068 | A1 | 10/2002 |
| JP | 2004-142927 | A | 5/2004 |
| JP | 2013-6699 | A | 1/2013 |
| WO | 03/008318 | A1 | 1/2003 |
| WO | 2008/041266 | A1 | 4/2008 |

OTHER PUBLICATIONS

Combined Chinese Office Action and Search Report dated May 2, 2018 in Chinese Patent Application No. 201480081165.4 (with English translation and English translation of Category of Cited Documents), 14 pages.

International Search Report dated Oct. 20, 2014 in PCT/JP2014/071309 filed Aug. 13, 2014.

* cited by examiner

MACHINE BASE ATTACHMENT DEVICE FOR ELEVATOR HOISTING MACHINE

TECHNICAL FIELD

This invention relates to a machine base attachment device for an elevator hoisting machine, which is used to attach a machine base that supports a hoisting machine to a guide rail that guides movement of an elevating body.

BACKGROUND ART

In a conventional elevator, a machine base for supporting a hoisting machine is attached between upper end portions of a pair of guide rails so that a load exerted on the machine base is supported by the pair of guide rails (see PTL 1).

CITATION LIST

Patent Literature

[PTL 1] WO 2008/041266

SUMMARY OF INVENTION

Technical Problem

Here, to achieve reductions in the weight of the guide rail and the manufacturing cost in a small capacity elevator, a forming rail (a steel plate molded rail) molded by bending steel plate may be used as the guide rail that guides the movement of the elevating body. A forming rail is weaker than a solid steel rail, and therefore, when a forming rail is used as the guide rail, the forming rail cannot easily support a load exerted thereon from the machine base supporting the hoisting machine. Moreover, when the machine base is fixed to a back surface of a rail flange portion of the forming rail, an insertion hole used to insert a fastening tool is provided in the weak rail flange portion, and therefore, by providing the insertion hole in the rail flange portion, the strength of the forming rail is reduced even further.

This invention has been designed to solve the problems described above, and an object thereof is to obtain an elevator hoisting machine with which a load from a machine base can be supported by a forming rail more reliably.

Solution to Problem

A machine base attachment device for an elevator hoisting machine according to this invention includes a reinforcing body attached to a forming rail that guides movement of an elevating body, and a machine base fixing member that is fixed to a machine base, the machine base supporting a hoisting machine that generates driving force for moving the elevating body, and attached to the forming rail, wherein the forming rail includes a pair of flange portions and a rail projecting portion fixed between the pair of flange portions, a groove portion that opens between the pair of flange portions is formed in the rail projecting portion, the reinforcing body includes an insertion portion that is inserted into the groove portion, and the machine base fixing member is attached to a part of the rail projecting portion in which the insertion portion is inserted.

Advantageous Effects of Invention

With the machine base attachment device for an elevator hoisting machine according to this invention, the machine base can be attached to a part of the forming rail that has been reinforced by the reinforcing body. As a result, a load from the machine base can be supported by the forming rail more reliably while reducing the weight and cost of the rail.

DESCRIPTION OF EMBODIMENTS

Preferred embodiments of this invention will be described below with reference to the drawings.

First Embodiment

Figure 1:
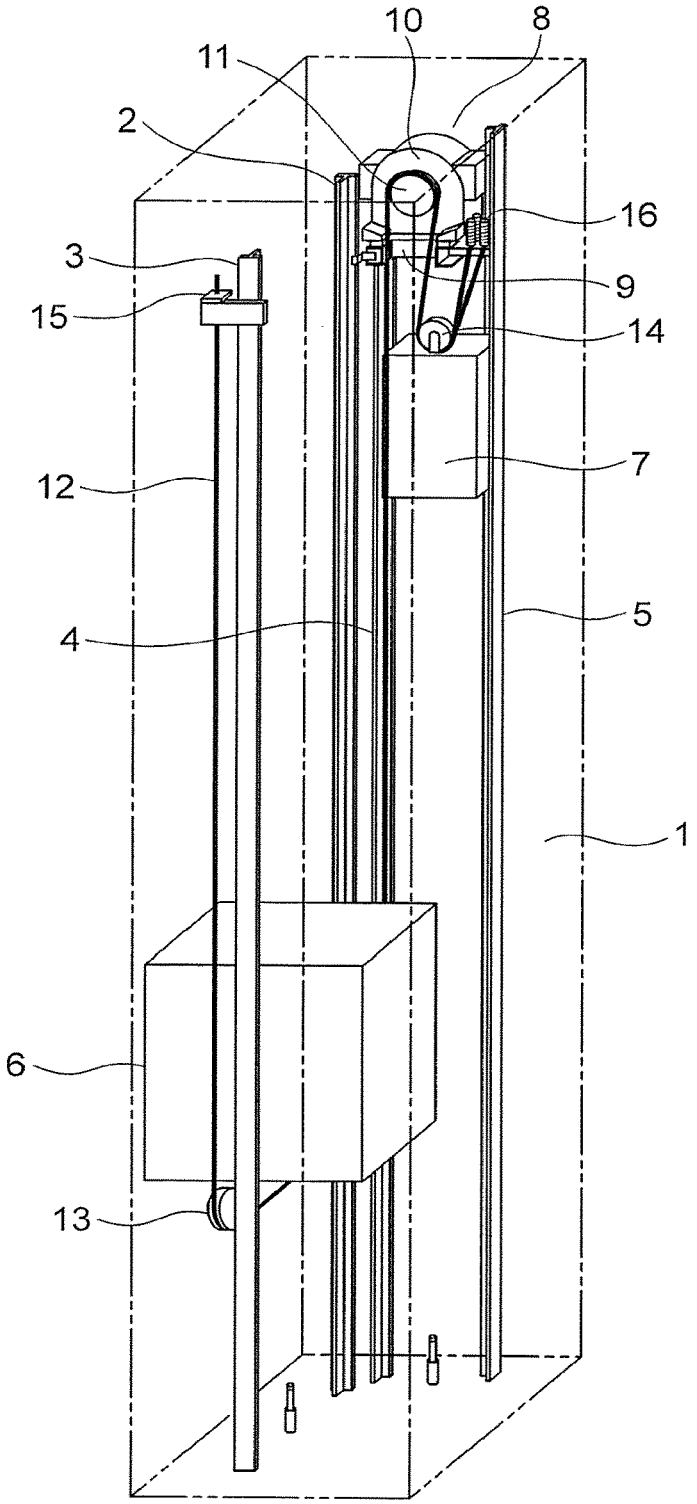
FIG. 1 is a view showing a configuration of an elevator according to a first embodiment of this invention.

FIG. 1 is a view showing a configuration of an elevator according to a first embodiment of this invention. In the drawing, a pair of car guide rails 2, 3 and a pair of counter weight guide rails 4, 5 are respectively disposed vertically in a hoistway 1. The pair of car guide rails 2, 3 are disposed at a remove from each other in a horizontal direction, and the pair of counter weight guide rails 4, 5 are likewise disposed at a remove from each other in the horizontal direction. Respective lower end portions of the car guide rails 2, 3 and the counter weight guide rails 4, 5 are fixed to a bottom surface of the hoistway 1.

In this example, the pair of car guide rails 2, 3 exist on one of two mutually orthogonal imaginary vertical planes, and the pair of counter weight guide rails 4, 5 exist on the other imaginary vertical plane. Further, in this example, the car guide rail 2, of the pair of car guide rails 2, 3, is disposed closer to the pair of counter weight guide rails 4, 5 than the car guide rail 3. Furthermore, in this example, the counter weight guide rail 4, of the pair of counter weight guide rails 4, 5, is disposed closer to the car guide rail 2 than the counter weight guide rail 5.

A car 6 serving as an elevating body exists between the pair of car guide rails 2, 3, and a counter weight 7 serving as an elevating body exists between the pair of counter weight guide rails 4, 5. The car 6 is capable of moving in a vertical direction while being guided by the pair of car guide rails 2, 3. The counter weight 7 is capable of moving in the vertical direction while being guided by the pair of counterweight guide rails 4, 5.

A hoisting machine 8 that generates driving force for moving the car 6 and the counter weight 7 is disposed in an upper portion of the hoistway 1. The hoisting machine 8 is supported by a common machine base 9. The machine base 9 is attached respectively to the car guide rail 2 and the counter weight guide rails 4, 5. As a result, a load from the machine base 9 is divided among, and thus supported by, the car guide rail 2 and the counter weight guide rails 4, 5.

The hoisting machine 8 includes a hoisting machine main body 10 including a motor, and a drive sheave 11 provided in the hoisting machine main body 10 and rotated by driving force from the hoisting machine main body 10. In this example, the hoisting machine 8 is disposed such that an axis of the drive sheave 11 is horizontal. Further, in this example, the hoisting machine 8 is a low-profile hoisting machine. In other words, in this example, a radial direction dimension of the hoisting machine 8 is larger than an axial direction dimension of the hoisting machine 8.

The car 6 and the counter weight 7 are suspended within the hoistway 1 by a plurality of ropes 12 serving as suspending bodies. Belts may also be used as the suspending bodies from which the car 6 and the counterweight 7 are suspended. A pair of car suspension sheaves 13 are provided on a lower portion of the car 6, and a counter weight suspension sheave 14 is provided on an upper portion of the counter weight 7. A first rope fixing device 15 is provided on an upper end portion of the car guide rail 3, and a second rope fixing device 16 is provided on the machine base 9. One end portion of each rope 12 is connected to the first rope fixing device 15, and another end portion of each rope 12 is connected to the second rope fixing device 16. Each rope 12 extends from the first rope fixing device 15 to the second rope fixing device 16, and is wound around the pair of car suspension sheaves 13, the drive sheave 11, and the counter weight suspension sheave 14, in that order. In other words, a 2:1 roping method is used as a method of suspending the car 6 and the counter weight 7 from the ropes 12.

Figure 2:
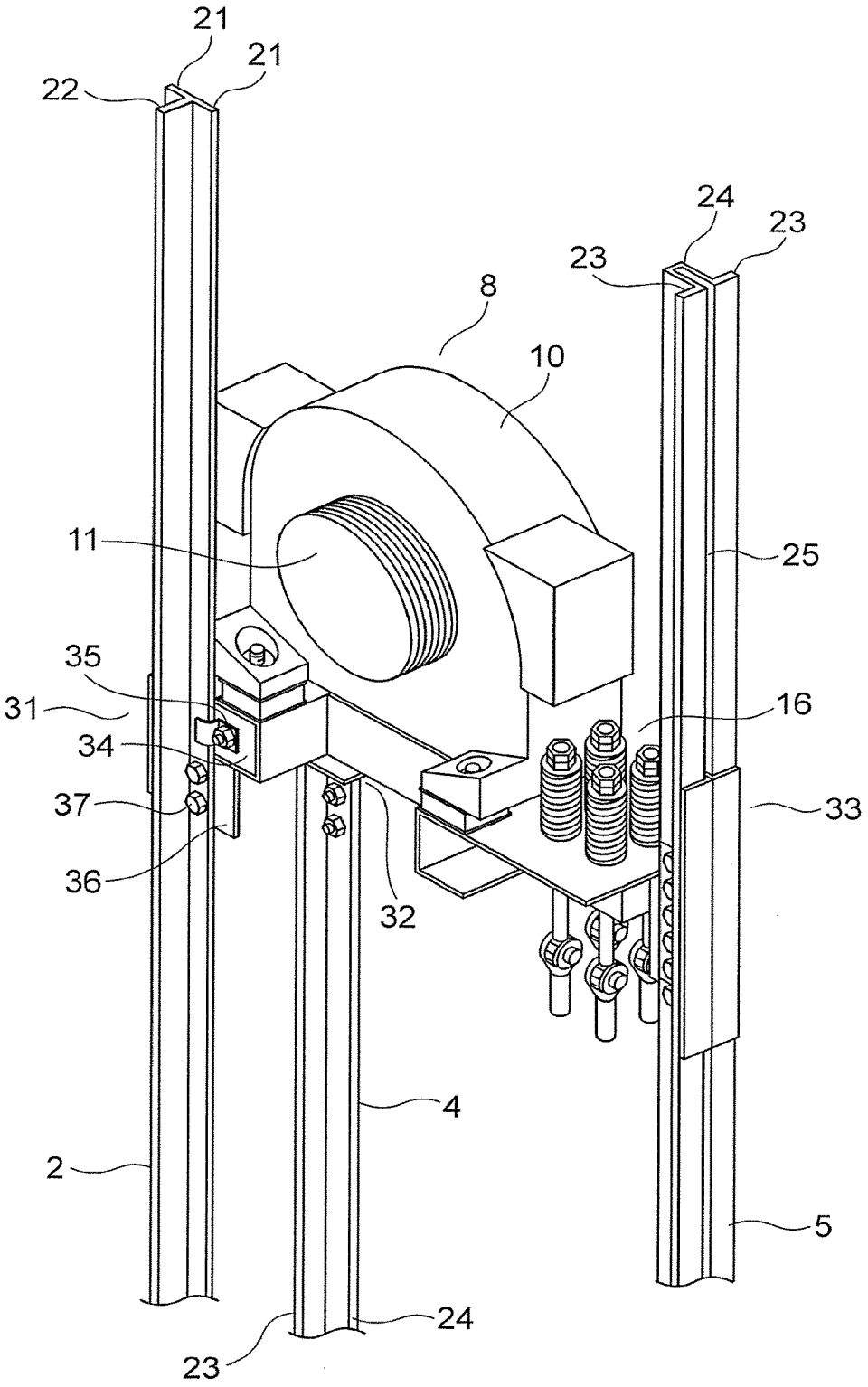
FIG. 2 is a perspective view of a hoisting machine shown in FIG. 1.
Figure 3:
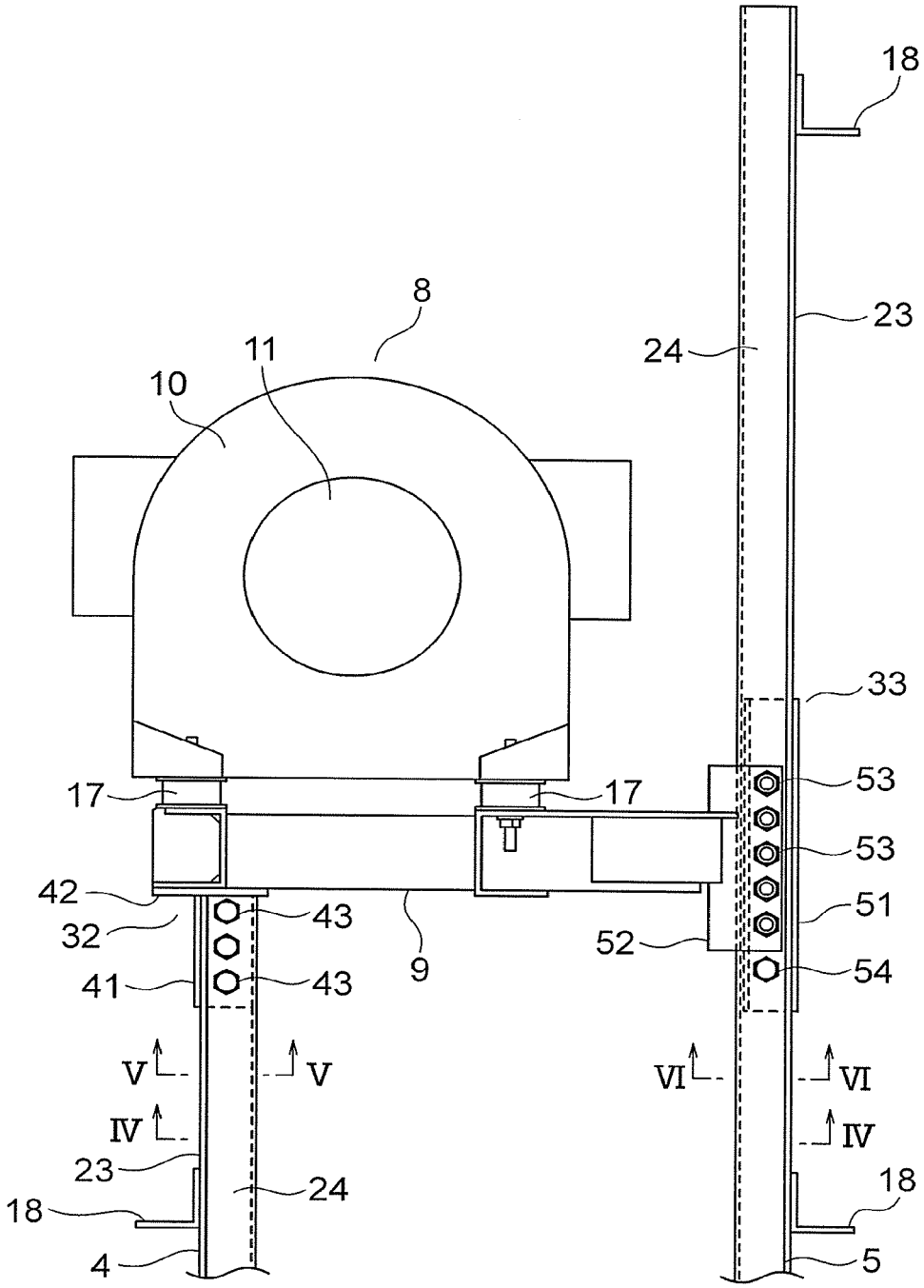
FIG. 3 is a front view of the hoisting machine shown in FIG. 2.
Figure 4:
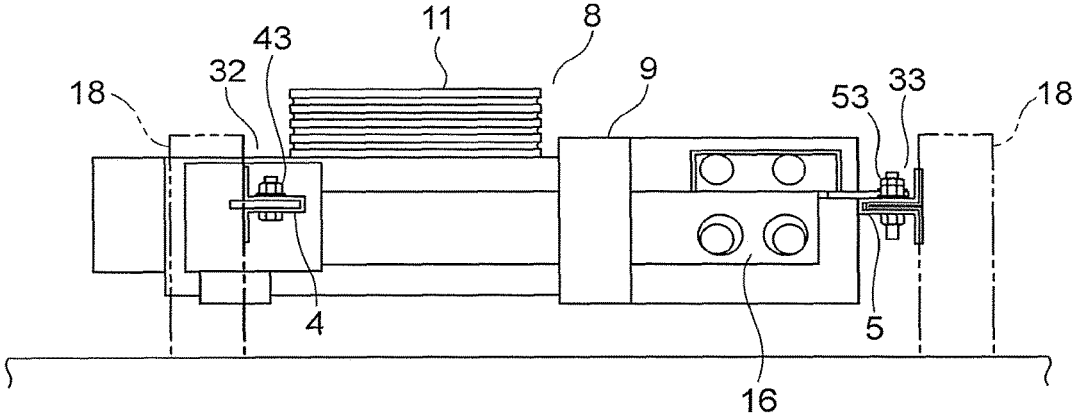
FIG. 4 is a sectional view taken along an IV-IV line in FIG. 3.

FIG. 2 is a perspective view of the hoisting machine 8 shown in FIG. 1. Further, FIG. 3 is a front view of the hoisting machine 8 shown in FIG. 2, and FIG. 4 is a sectional view taken along an IV-IV line in FIG. 3. The hoisting machine 8 is supported by the machine base 9 via a plurality of vibration prevention devices 17, each of which includes an elastic body (rubber, a spring, or the like, for example). In this example, the hoisting machine 8 is supported by the machine base 9 via four vibration prevention devices 17 disposed in four corners in a bottom portion of the hoisting machine main body 10.

The car guide rails 2, 3 are solid steel rails. Further, as shown in FIG. 2, the car guide rails 2, 3 each include a pair of rail flange portions 21 and a rail projecting portion 22 fixed between the pair of rail flange portions 21. The car guide rails 2, 3 each have a T-shaped cross-section formed by the pair of rail flange portions 21 and the rail projecting portion 22. As shown in FIG. 1, the pair of car guide rails 2, 3 are disposed in parallel such that the respective rail projecting portions 22 thereof oppose each other. The car 6 is guided by the respective rail projecting portions 22 of the car guide rails 2, 3.

The counter weight guide rails 4, 5 are forming rails that are molded by subjecting steel plate to plastic deformation. Further, the counterweight guide rails 4, 5 each include a pair of rail flange portions 23 and a rail projecting portion 24 fixed between the pair of rail flange portions 23. The pair of counter weight guide rails 4, 5 are disposed in parallel such that the respective rail projecting portions 24 thereof oppose each other. The counter weight 7 is guided by the respective rail projecting portions 24 of the counterweight guide rails 4, 5.

As shown in FIG. 3 and FIG. 4, the car guide rails 2, 3 and the counter weight guide rails 4, 5 are attached to a plurality of brackets 18 fixed to an inner wall surface of the hoistway 1. Further, a position of an upper end portion of the counter weight guide rail 4 is set to be lower than positions of respective upper end portions of the car guide rails 2, 3 and the counter weight guide rail 5.

The machine base 9 is placed on the counter weight guide rail 4 and attached in this condition to the car guide rail 2 and the counter weight guide rails 4, 5. As shown in FIG. 2, the machine base 9 is attached to the car guide rail 2 by a rail clipping device 31. Further, the machine base 9 is attached to the counter weight guide rail 4 by a first machine base attachment device 32. Furthermore, the machine base 9 is attached to the counter weight guide rail 5 by a second machine base attachment device 33.

As shown in FIG. 2, the rail clipping device 31 includes an attachment plate 34 placed against a back surface of the car guide rail 2, and a plurality of rail clips 35 provided on the attachment plate 34 so that the pair of rail flange portions 21 of the car guide rail 2 are sandwiched between the rail clips 35 and the attachment plate 34.

The attachment plate 34 is fixed to the machine base 9 by welding or the like, for example. The machine base 9 is attached to the car guide rail 2 by sandwiching the rail flange portions 21 between the attachment plate 34 and the rail clips 35 and fastening the attachment plate 34 and the rail clips 35 using fastening tools. In this example, bolts and nuts are used as the fastening tools.

A bearing member 36 that supports the machine base 9 from below is attached to the car guide rail 2 by a plurality of fastening tools 37. Pluralities of fastening insertion holes are provided respectively in the rail flange portions 21 of the car guide rail 2 and the bearing member 36. Each fastening tool 37 includes a bolt that is inserted into one of the fastening insertion holes provided respectively in the rail flange portions 21 and the bearing member 36, and a nut that is attached to the bolt. The bearing member 36 is attached to the car guide rail 2 by fastening the rail flange portions 21 and the bearing member 36 together using the nuts and bolts of the fastening tools 37.

Figure 5:
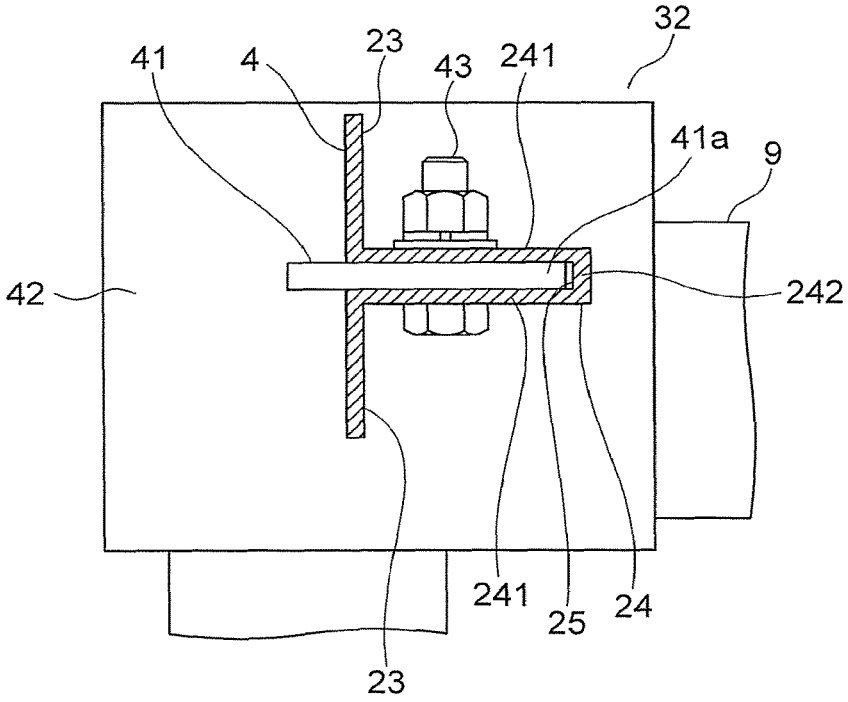
FIG. 5 is a sectional view taken along a V-V line in FIG. 3.
Figure 6:
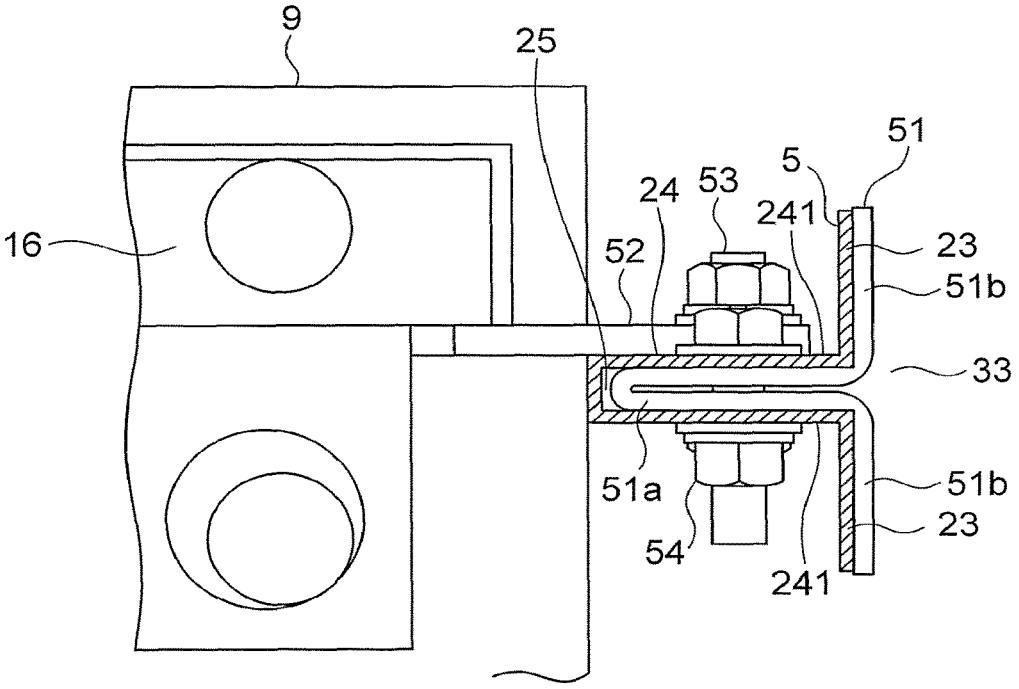
FIG. 6 is a sectional view taken along a VI-VI line in FIG. 3.

FIG. 5 is a sectional view taken along a V-V line in FIG. 3, and FIG. 6 is a sectional view taken along a VI-VI line in FIG. 3. In each of the counter weight guide rails 4, 5, the pair of rail flange portions 23 are arranged side by side at a remove from each other on a shared plane. The rail projecting portion 24 projects from the shared plane on which the pair of rail flange portions 23 exist. Further, the rail projecting portion 24 of each of the counter weight guide rails 4, 5 includes a pair of opposing plate portions 241 projecting respectively from the pair of rail flange portions 23 so as to oppose each other in a width direction of the rail projecting portion 24, and an end plate portion 242 that connects respective end portions of the pair of opposing plate portions 241. Hence, the rail projecting portion 24 has a substantially U-shaped cross-section. Further, a groove portion 25 formed by the pair of opposing plate portions 241 and the end plate portion 242 is provided in the rail projecting portion 24 so as to extend in a lengthwise direction of the rail flange portions 23. The groove portion 25 opens between the pair of rail flange portions 23, and also opens onto an upper surface of each of the counter weight guide rails 4, 5.

The first machine base attachment device 32 includes a first reinforcing body 41 that is attached to the counter weight guide rail 4 in order to reinforce the counter weight guide rail 4, and a first attachment plate 42 serving as a machine base fixing member that is fixed to the machine base 9 and attached to the counter weight guide rail 4.

As shown in FIG. 3, the first attachment plate 42 is fixed horizontally to a lower surface of the machine base 9 by welding or the like, for example. Further, the first attachment plate 42 is placed over the upper surface of the counter weight guide rail 4.

The first reinforcing body 41 is fixed to the first attachment plate 42 by welding or the like, for example, so as to project downward from a lower surface of the first attachment plate 42. Further, the first reinforcing body 41 includes an insertion portion 41*a* that is inserted into the groove portion 25. The insertion portion 41*a* of the first reinforcing body 41 is inserted into the groove portion 25 from the lower surface of the first attachment plate 42 through the open portion of the groove portion 25 formed in the upper surface of the counter weight guide rail 4. In this example, the first reinforcing body 41 is formed as a rectangular plate, and the first reinforcing body 41 is inserted into the groove portion 25 after aligning a long side of the first reinforcing body 41 with the lengthwise direction of the groove portion 25. As a result, the first attachment plate 42 is attached from above to the part of the rail projecting portion 24 of the counter weight guide rail 4 in which the insertion portion 41*a* is inserted.

As shown in FIG. 3, the rail projecting portion 24 of the counter weight guide rail 4 and the insertion portion 41*a* of the first reinforcing body 41 are fastened together by a plurality of fastening tools 43 disposed at intervals in the lengthwise direction of the groove portion 25. Pluralities of fastening insertion holes are provided respectively in the opposing plate portions 241 of the rail projecting portion 24 of the counter weight guide rail 4 and the insertion portion 41*a* of the first reinforcing body 41. The positions of the fastening insertion holes provided in the counter weight guide rail 4 are set to pass through a centroid of the counter weight guide rail 4 on a cross-section that is perpendicular to the lengthwise direction of the counter weight guide rail 4. As shown in FIG. 5, each fastening tool 43 includes a bolt that is inserted into one of the fastening insertion holes provided respectively in the opposing plate portions 241 and the insertion portion 41*a*, and a nut that is attached to the bolt. The first reinforcing body 41 is attached to the rail projecting portion 24 of the counter weight guide rail 4 by fastening the opposing plate portions 241 and the insertion portion 41*a* together using the nuts and bolts of the fastening tools 43.

As shown in FIG. 3, the second machine base attachment device 33 includes a second reinforcing body 51 that is attached to the counter weight guide rail 5 in order to reinforce the counter weight guide rail 5, and a second attachment plate 52 serving as a machine base fixing member that is fixed to the machine base 9 and attached to the counter weight guide rail 5.

The second attachment plate 52 is fixed to the machine base 9 by welding or the like, for example, so as to extend in the lengthwise direction of the counter weight guide rail 5. Further, as shown in FIG. 6, the second attachment plate 52 is placed against one of the opposing plate portions 241 of the rail projecting portion 24 of the counter weight guide rail 5, and attached in this condition to a side face of the rail projecting portion 24. In the lengthwise direction of the counter weight guide rail 5, a dimension of the second attachment plate 52 is larger than a dimension of the machine base 9.

The second reinforcing body 51 is molded by subjecting steel plate to plastic deformation. Further, as shown in FIG. 6, the second reinforcing body 51 includes an insertion portion 51*a* that is inserted into the groove portion 25 of the counter weight guide rail 5, and a pair of overlapping plate portions 51*b* that project toward respective sides from the insertion portion 51*a* so as to overlap the pair of rail flange portions 23 individually. The second attachment plate 52 is attached to the part of the rail projecting portion 24 of the counter weight guide rail 5 in which the insertion portion 51*a* of the second reinforcing body 51 is inserted. In this example, as shown in FIG. 3, a dimension of the second reinforcing body 51 is larger than a dimension of the second attachment plate 52 in the lengthwise direction of the counter weight guide rail 5.

The rail projecting portion 24 of the counter weight guide rail 5, the insertion portion 51*a* of the second reinforcing body 51, and the second attachment plate 52 are fastened together by a plurality of fastening tools 53 disposed at intervals in the lengthwise direction of the groove portion 25. Pluralities of fastening insertion holes are provided respectively in the opposing plate portions 241 of the rail projecting portion 24 of the counter weight guide rail 5, the insertion portion 51*a* of the second reinforcing body 51, and the second attachment plate 52. The positions of the fastening insertion holes provided in the counter weight guide rail 5 are set to pass through a centroid of the counter weight guide rail 5 on a cross-section that is perpendicular to the lengthwise direction of the counter weight guide rail 5. As shown in FIG. 6, each fastening tool 53 includes a bolt that is inserted into one of the fastening insertion holes provided respectively in the second attachment plate 52, the opposing plate portions 241, and the insertion portion 51*a*, and a nut that is attached to the bolt. The second attachment plate 52 and the second reinforcing body 51 are attached to the rail projecting portion 24 of the counter weight guide rail 5 by fastening the second attachment plate 52, the opposing plate portions 241, and the insertion portion 51*a* together using the nuts and bolts of the fastening tools 53.

In this example, a dimension of the overlapping plate portion 51*b* is set to be slightly larger than a dimension of the rail flange portion 23 in a width direction of the counter weight guide rail 5. Further, in this example, a thickness dimension of the overlapping plate portion 51*b* is set to be larger than a thickness dimension of the rail flange portion 23. By inserting the insertion portion 51*a* of the second reinforcing body 51 into the groove portion 25 such that the overlapping plate portions 51*b* respectively overlap the rail flange portions 23, the counter weight guide rail 5 is reinforced.

As shown in FIG. 3, the rail projecting portion 24 of the counter weight guide rail 5 and the insertion portion 51*a* of the second reinforcing body 51 are fastened together by an additional fastening tool 54 as well as the plurality of fastening tools 53. The additional fastening tool 54 is disposed away from an attachment range of the second attachment plate 52. In this example, the additional fastening tool 54 is positioned below the plurality of fastening tools 53. Reinforcing body attachment insertion holes are provided respectively in the opposing plate portions 241 of the counter weight guide rail 5 and the insertion portion 51*a* of the second reinforcing body 51. The positions of the reinforcing body attachment insertion holes provided in the counter weight guide rail 5 are set to pass through the centroid of the counterweight guide rail 5 on a cross-section that is perpendicular to the lengthwise direction of the counter weight guide rail 5. The additional fastening tool 54 includes a bolt that is inserted into the fastening insertion holes provided respectively in the opposing plate portions 241 and the insertion portion 51*a*, and a nut that is attached to the bolt. The rail projecting portion 24 of the counter weight guide rail 5 and the insertion portion 51*a* of the second reinforcing body 51 are fastened to each other by fastening the bolt and nut of the additional fastening tool 54.

When the counter weight guide rail 5 is shipped from a factory, the second reinforcing body 51 is fixed to the counter weight guide rail 5 provisionally in advance by the additional fastening tool 54. The counter weight guide rail 5 is then installed in the hoistway 1 with the second reinforcing body 51 provisionally fixed to the counter weight guide rail 5.

The machine base 9 is attached to the car guide rail 2 and the counter weight guide rails 4, 5 after installing the pair of car guide rails 2, 3 and the pair of counter weight guide rails 4, 5 in the hoistway 1.

To attach the machine base 9 to the car guide rail 2 and the counter weight guide rails 4, 5, the machine base 9 is placed on the counter weight guide rail 4 such that the first attachment plate 42 is placed over the upper surface of the counter weight guide rail 4. At this time, the second attachment plate 52 is placed against the side face of the rail projecting portion 24 of the counter weight guide rail 5, and the attachment plate 34 and bearing member 36 are placed against the back surface of the car guide rail 2. Moreover, at this time, the insertion portion 41*a* of the first reinforcing body 41 is inserted into the groove portion 25 in the counter weight guide rail 4.

Next, the attachment plate 34 is fixed to the car guide rail 2 by the plurality of rail clips 35, and the bearing member 36 is fixed to the car guide rail 2 by the fastening tools 37. Further, the insertion portion 41*a* of the first reinforcing body 41 and the rail projecting portion 24 of the counter weight guide rail 4 are fastened together by the plurality of fastening tools 43. Furthermore, the insertion portion 51*a* of the second reinforcing body 51, which is fixed provisionally to the counter weight guide rail 5 by the fastening tool 54, the rail projecting portion 24 of the counter weight guide rail 5, and the second attachment plate 52 are fastened together by the plurality of fastening tools 53. At this time, the provisional fixing fastening tool 54 is fully fastened. As a result, the machine base 9 is attached to the car guide rail 2 and the counter weight guide rails 4, 5.

Hence, in the first and second machine base attachment devices 32, 33, the respective insertion portions 41*a*, 51*a* of the first and second reinforcing bodies 41, 51 are inserted into the groove portions 25, whereupon the first and second attachment plates 42, 52 to which the machine base 9 is fixed are attached to the parts of the respective rail projecting portions 24 of the counter weight guide rails 4, 5 in which the insertion portions 41*a*, 51*a* are inserted, and therefore the machine base 9 can be attached to the parts of the counter weight guide rails 4, 5 that are reinforced by the first and second reinforcing bodies 41, 51. As a result, the counter-weight guide rails 4, 5 can be formed from forming rails, thereby achieving reductions in the weight and cost thereof, while ensuring that a load from the machine base 9 can be supported reliably by the forming rails.

Further, the first attachment plate 42 is placed over the upper surface of the counter weight guide rail 4, the insertion portion 41 of the first reinforcing body 41 is inserted into the groove portion 25 from the lower surface of the first attachment plate 42, and the insertion portion 41*a* and rail projecting portion 24 are fastened together by the fastening tools 43 inserted into the fastening insertion holes provided respectively in the insertion portion 41*a* and the rail projecting portion 24, and therefore an offset load exerted on the counter weight guide rail 4 can be reduced even further. As a result, the counter weight guide rail 4 can be prevented reliably from deforming under the load exerted thereon from the machine base 9 even when the counter weight guide rail 4 is formed from a forming rail.

Furthermore, the second attachment plate 52 is attached to the side face of the rail projecting portion 24 of the counter weight guide rail 5, whereupon the insertion portion 51*a* and the rail projecting portion 24 are fastened together by the fastening tools 53 inserted into the fastening insertion holes provided respectively in the insertion portion 51*a* and the rail projecting portion 24, and therefore the machine base 9 can be attached to a lengthwise direction intermediate portion of the counter weight guide rail 5 while preventing the counter weight guide rail 5 from deforming under the load exerted thereon from the machine base 9 even when the counter weight guide rail 5 is formed from a forming rail. As a result, the position in which the machine base 9 is attached to the forming rail can be selected with a greater degree of freedom.

Moreover, the positions of the fastening insertion holes through which the fastening tools 43, 53 are inserted pass through the respective centroids of the counter weight guide rails 4, 5, and therefore offset loads exerted on the respective counter weight guide rails 4, 5 can be reduced, leading to a reduction in the likelihood of a local load being exerted on the counter weight guide rails 4, 5. As a result, the load from the machine base 9 can be supported by the forming rails even more reliably.

Second Embodiment

Figure 7:
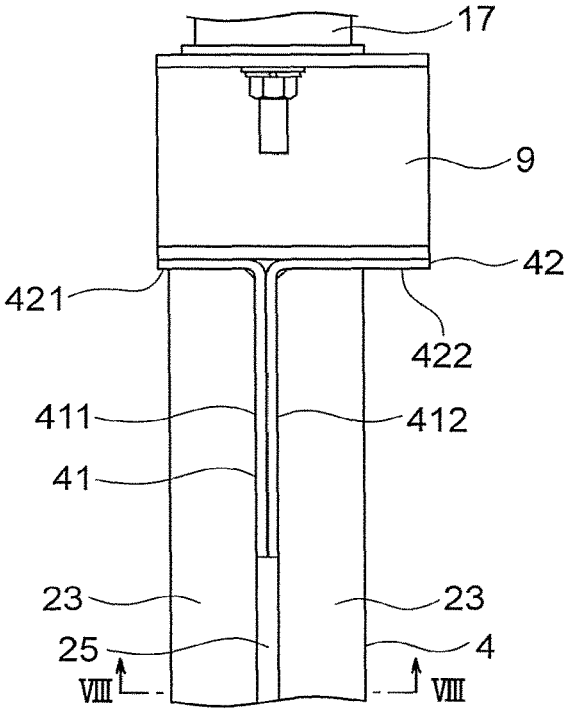
FIG. 7 is a side view showing a first machine base attachment device for an elevator according to a second embodiment of this invention.
Figure 8:
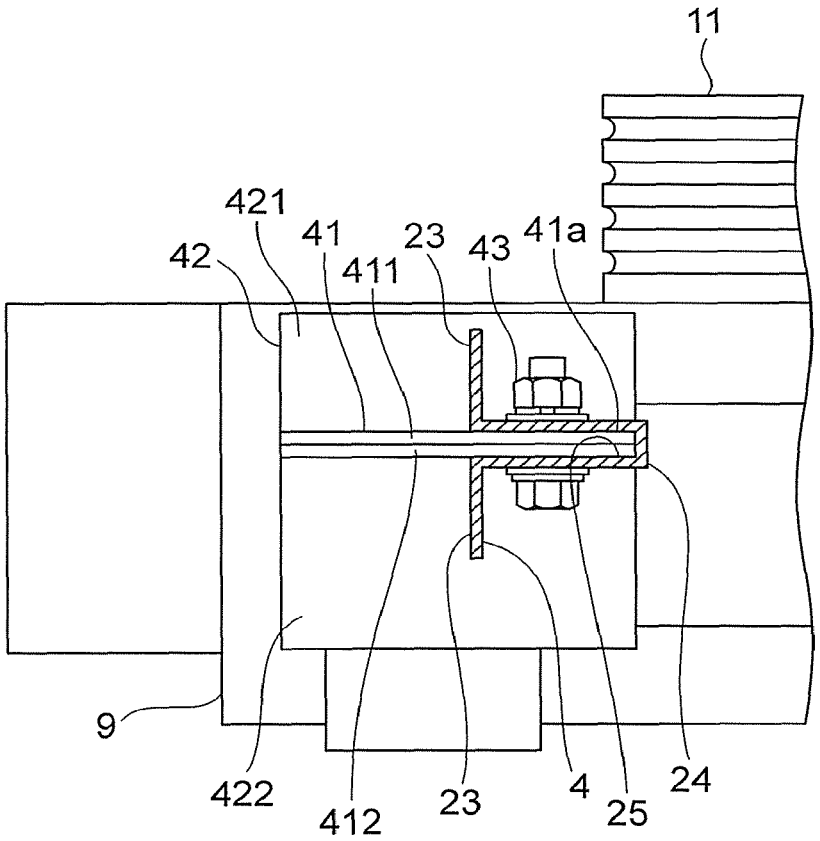
FIG. 8 is a sectional view taken along a VIII-VIII line in FIG. 7.

FIG. 7 is a side view showing a first machine base attachment device for an elevator according to a second embodiment of this invention. Further, FIG. 8 is a sectional view taken along a VIII-VIII line in FIG. 7. Note that FIG. 8 corresponds to FIG. 5 of the first embodiment. The first attachment plate 42 of the first machine base attachment device 32 is constituted by a pair of placed plate portions 421, 422 that are placed side by side on the upper surface of the counter weight guide rail 4. The pair of placed plate portions 421, 422 are arranged in a width direction of the counter weight guide rail 4. A boundary between the pair of placed plate portions 421, 422 is positioned above the groove portion 25.

The first reinforcing body 41 of the first machine base attachment device 32 is constituted by a pair of overlapping plate portions 411, 412 that overlap each other in a width direction of the groove portion 25. The overlapping plate portion 411 is fixed to the placed plate portion 421, and the overlapping plate portion 412 is fixed to the placed plate portion 422. The overlapping plate portion 411 and the placed plate portion 421 are formed integrally by bending a single plate. The overlapping plate portion 412 and the placed plate portion 422 are formed integrally by bending another single plate. All other configurations are identical to the first embodiment.

Hence, in the first machine base attachment device 32, the overlapping plate portion 411 and the placed plate portion 421 are formed integrally by bending a single plate, while the overlapping plate portion 412 and the placed plate portion 422 are formed integrally by bending another single plate, and therefore the first reinforcing body 41 and the first attachment plate 42 can be constructed simply by bending and aligning two plates. As a result, the first machine base attachment device 32 can be manufactured more easily. Furthermore, respective parts of the first reinforcing body 41 and the first attachment plate 42 are formed from single plates, and therefore a joint strength between the first reinforcing body 41 and the first attachment plate 42 can be improved. As a result, the forming rail can be reinforced by the first reinforcing body 41 even more reliably.

Third Embodiment

Figure 9:
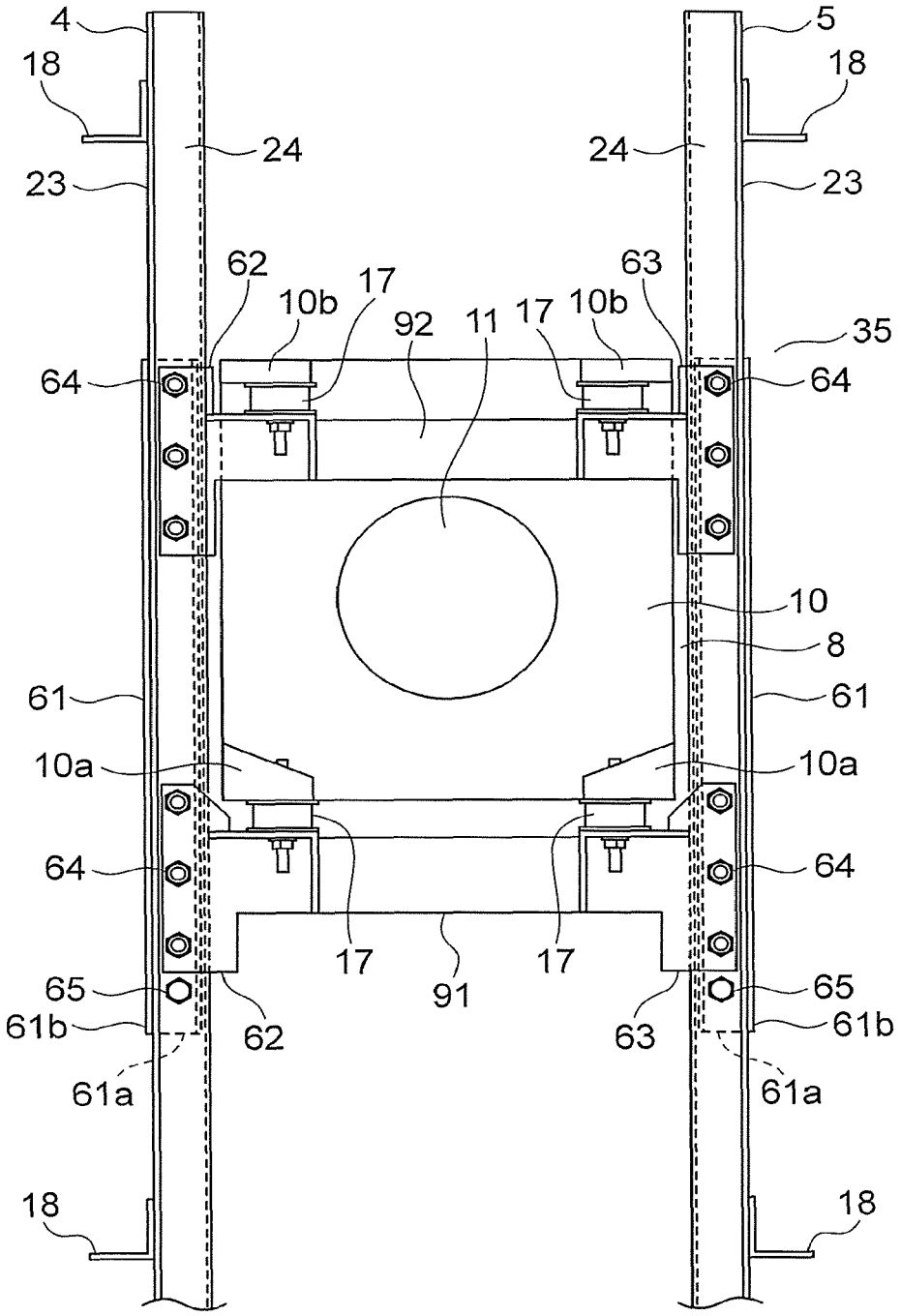
FIG. 9 is a front view showing a condition in which a machine base of a hoisting machine is attached to a pair of counterweight guide rails by a second machine base attachment device according to a third embodiment of this invention.

FIG. 9 is a front view showing a condition in which a machine base of a hoisting machine is attached to a pair of counter weight guide rails by a second machine base attachment device according to a third embodiment of this invention. The hoisting machine 8 is disposed between the pair of counter weight guide rails 4, 5. Further, the hoisting machine 8 exists between a first machine base 91 and a second machine base 92 (in other words, a pair of machine bases 91, 92) disposed at a remove from each other in the vertical direction. The first machine base 91 supports the hoisting machine 8 from a lower portion of the hoisting machine 8, and the second machine base 92 supports the hoisting machine 8 from an upper portion of the hoisting machine 8.

A pair of lower portion supporting projecting portions 10*a* projecting respectively from the hoisting machine main body 10 in an axial direction of the drive sheave 11 are provided on the lower portion of the hoisting machine 8. Further, a pair of upper portion supporting projecting portions 10*b* projecting respectively from the hoisting machine main body 10 in the axial direction of the drive sheave 11 are provided on the upper portion of the hoisting machine 8. The lower portion supporting projecting portions 10*a* are supported respectively by the first machine base 91 via the vibration prevention devices 17, and the upper portion supporting projecting portions 10*b* are supported respectively by the second machine base 92 via the vibration prevention devices 17. In other words, the lower portion supporting projecting portions 10*a* are placed on the first machine base 91 via the vibration prevention devices 17, the upper portion supporting projecting portions 10*b* are placed on the second machine base 92 via the vibration prevention devices 17, and in this condition, the hoisting machine 8 is supported by the first and second machine bases 91, 92.

The first and second machine bases 91, 92 are attached to the pair of counter weight guide rails 4, 5 by a machine base attachment device 35. The machine base attachment device 35 includes a pair of reinforcing bodies 61 serving as a pair of reinforcing bodies that are attached respectively to the counter weight guide rails 4, 5 in order to reinforce the counterweight guide rail 4, 5, two attachment plates 62 serving as machine base fixing members that are fixed respectively to the first and second machine bases 91, 92 and attached to the counter weight guide rail 4, and two attachment plates 63 serving as machine base fixing members that are fixed respectively to the first and second machine bases 91, 92 and attached to the counter weight guide rail 5.

The respective attachment plates 62, 63 are configured similarly to the second attachment plate 52 of the first embodiment. The respective attachment plates 62, 63 are fixed individually to the first and second machine bases 91, 92 by welding or the like, for example. Further, the attachment plates 62 are attached to a side face of the rail projecting portion 24 of the counter weight guide rail 4, while the attachment plates 63 are attached to a side face of the rail projecting portion 24 of the counter weight guide rail 5.

A lengthwise direction dimension of one of the reinforcing bodies 61 is set to be longer than a distance between an upper surface of the upper side attachment plate 62, of the two attachment plates 62, and a lower surface of the lower side attachment plate 62. A lengthwise direction dimension of the other reinforcing body 61 is set to be longer than a distance between an upper surface of the upper side attachment plate 63, of the two attachment plates 63, and a lower surface of the lower side attachment plate 63.

The reinforcing bodies 61 are configured similarly to the second reinforcing body 51 of the first embodiment. In other words, the reinforcing bodies 61 are steel plate molded reinforcing bodies molded by subjected steel plate to plastic deformation. Further, each reinforcing body 61 includes an insertion portion 61*a* and a pair of overlapping plate portions 61*b* projecting to respective sides from the insertion portion 61*a*. One of the reinforcing bodies 61 is attached to the counter weight guide rail 4 by inserting the insertion portion 61*a* into the groove portion 25 of the counter weight guide rail 4 such that the respective overlapping plate portions 61*b* overlap the rail flange portions 23 of the counter weight guide rail 4. The other reinforcing body 61 is attached to the counter weight guide rail 5 by inserting the insertion portion 61*a* into the groove portion 25 of the counter weight guide rail 5 such that the respective overlapping plate portions 61*b* overlap the rail flange portions 23 of the counter weight guide rail 5.

The attachment plates 62 are attached to parts of the rail projecting portion 24 of the counter weight guide rail 4 in which the insertion portion 61*a* of the reinforcing body 61 is inserted. The rail projecting portion 24 of the counter weight guide rail 4, the insertion portion 61*a* of the reinforcing body 61, and the attachment plates 62 are fastened together by a plurality of fastening tools 64 disposed at intervals in the lengthwise direction of the groove portion 25. Each fastening tool 64 includes a bolt and a nut. Pluralities of fastening insertion holes used for inserting the bolts of the fastening tools 64 are provided respectively in the rail projecting portion 24 of the counter weight guide rail 4, the insertion portion 61*a* of the reinforcing body 61, and the attachment plates 62. Similarly to the fastening tools 53 of the first embodiment, the fastening tools 64 fasten the rail projecting portion 24 of the counter weight guide rail 4, the insertion portion 61*a* of the reinforcing body 61, and the attachment plates 62 between the bolts inserted into the fastening insertion holes and the nuts attached to the bolts.

The attachment plates 63 are attached to parts of the rail projecting portion 24 of the counterweight guide rail 5 in which the insertion portion 61*a* of the other reinforcing body 61 is inserted. The rail projecting portion 24 of the counter weight guide rail 5, the insertion portion 61*a* of the reinforcing body 61, and the attachment plates 63 are fastened together by a plurality of fastening tools 64 disposed at intervals in the lengthwise direction of the groove portion 25. Pluralities of fastening insertion holes used for inserting bolts of the fastening tools 64 are provided respectively in the rail projecting portion 24 of the counter weight guide rail 5, the insertion portion 61*a* of the reinforcing body 61, and the attachment plates 63. The fastening tools 64 fasten the rail projecting portion 24 of the counterweight guide rail 5, the insertion portion 61*a* of the reinforcing body 61, and the attachment plates 63 between bolts inserted into the fastening insertion holes and nuts attached to the bolts.

In each of the counterweight guide rails 4, 5, the rail projecting portion 24 and the insertion portion 61*a* are fastened together by a provisional fixing additional fastening tool 65 having a similar configuration to the additional fastening tool 54 of the first embodiment. The additional fastening tool 65 is disposed away from respective attachment ranges of the attachment plates 62, 63. In this example, the additional fastening tool 65 is positioned below all of the fastening tools 64. Reinforcing body attachment insertion holes are provided respectively in the rail projecting portion 24 of each counter weight guide rail 4, 5 and the insertion portion 61*a* of each reinforcing body 61. The additional fastening tools 65 provided separately to the fastening tools 64 fasten the rail projecting portions 24 to the insertion portions 61*a* between bolts inserted into the fastening insertion holes and nuts attached to the bolts. The second rope fixing device, to which the ropes 12 used to suspend the car 6 and the counter weight 7 are connected, is provided on the first machine base 91. All other configurations are identical to the first embodiment.

When the counter weight guide rails 4, 5 are shipped from the factory, the reinforcing bodies 61 are respectively fixed to the counter weight guide rails 4, 5 provisionally in advance by the additional fastening tools 65. The counter weight guide rails 4, 5 are then installed in the hoistway 1 with the reinforcing bodies 61 provisionally fixed to the respective counter weight guide rails 4, 5.

The first and second machine bases 91, 92 are attached to the counter weight guide rails 4, 5 after installing the pair of car guide rails 2, 3 and the pair of counter weight guide rails 4, 5 in the hoistway 1.

To attach the first and second machine bases 91, 92 to the counter weight guide rails 4, 5, the attachment plates 62 are placed against the side face of the rail projecting portion 24 of the counter weight guide rail 4, the attachment plates 63 are placed against the side face of the rail projecting portion 24 of the counter weight guide rail 5, and in this condition, the attachment plates 62 are fixed to the counter weight guide rail 4 by the fastening tools 64 and the attachment plates 63 are fixed to the counter weight guide rail 5 by the fastening tools 64. The hoisting machine 8 is then placed on the first and second machine bases 91, 92 via the plurality of vibration prevention devices 17. As a result, an operation to attach the first and second machine bases 91, 92 to the counter weight guide rails 4, 5 and an operation to install the hoisting machine 8 are completed.

Likewise with this configuration, in which the first and second machine bases 91, 92 are disposed at a remove from each other in the vertical direction and the hoisting machine 8 is supported between the first and second machine bases 91, 92, the first and second machine bases 91, 92 can be attached to the parts of the counter weight guide rails 4, 5 that have been reinforced by the reinforcing bodies 61, and therefore the counter weight guide rails 4, 5 can be prevented reliably from deforming under loads exerted thereon from the first and second machine bases 91, 92 even when the counter weight guide rails 4, 5 are formed from forming rails.

Note that in the example described above, the insertion portion 61*a* of the shared reinforcing body 61 is inserted into the part of the rail projecting portion 24 of the counterweight guide rail 4 to which the respective attachment plates 62 are attached, but instead of providing the shared reinforcing body 61, insertion portions of a plurality of different reinforcing bodies may be inserted respectively into the groove portion 25 in the rail projecting portion 24 of the counter weight guide rail 4, and the attachment plates 62 may be attached individually to the parts of the rail projecting portion 24 in which the respective insertion portions are inserted.

Further, in the example described above, the insertion portion 61*a* of the shared reinforcing body 61 is inserted into the part of the rail projecting portion 24 of the counterweight guide rail 5 to which the respective attachment plates 63 are attached, but instead of providing the shared reinforcing body 61, insertion portions of a plurality of different reinforcing bodies may be inserted respectively into the groove portion 25 in the rail projecting portion 24 of the counter weight guide rail 5, and the attachment plates 63 may be attached individually to the parts of the rail projecting portion 24 in which the respective insertion portions are inserted.

The invention claimed is:

1. A machine base attachment device, comprising:

a reinforcing body attached to a forming rail that guides movement of an elevating body; and a machine base fixing member, attached to the forming rail, that is fixed to a machine base, the machine base supporting a hoisting machine that generates driving force for moving the elevating body, wherein the forming rail includes a pair of flange portions and a rail projecting portion between the pair of flange portions, a groove portion in the rail projecting portion, the groove portion disposed between the pair of flange portions, the reinforcing body includes an insertion portion that is inserted into the groove portion, the insertion portion attached to the groove portion by a fastener that passes through holes of the rail projection portion and the insertion portion, and the machine base fixing member is attached to a part of the rail projecting portion in which the insertion portion is inserted.

2. The machine base attachment device according to claim 1, wherein:

the groove portion is open at an upper surface of the forming rail, the machine base fixing member is placed over the upper surface of the forming rail, and the insertion portion is fixed to a lower surface of the machine base fixing member and inserted into the groove portion from the lower surface of the machine base fixing member.

3. The machine base attachment device for an elevator hoisting machine according to claim 2, wherein:

the machine base fixing member includes a pair of placed plate portions that are placed side by side on the upper surface of the forming rail, the reinforcing body includes a pair of overlapping plate portions that overlap each other in a width direction of the groove portion, one of the placed plate portions and one of the overlapping plate portions are formed integrally by bending a single plate, and the other placed plate portion and the other overlapping plate portion are formed integrally by bending another single plate.

4. The machine base attachment device according to claim 1, wherein:

the machine base fixing member is attached to a side face of the rail projecting portion by the fastener which passes through the insertion portion, the rail projecting portion, and the machine base fixing member.

5. The machine base attachment device according to claim 4, wherein:

the elevating body exists between a pair of the forming rails spaced apart from each other in a horizontal direction, the hoisting machine exists between a pair of the machine bases spaced apart from each other in a vertical direction, and a plurality of the machine base fixing members, which are attached individually to the respective rail projecting portions of the forming rails, are fixed respectively to the machine bases.

6. An elevator system, comprising:

the machine base attachment device of claim 1;

the forming rail;

the elevating body; and the hoisting machine which is attached to the machine base, the hoisting machine operatively connected to the elevating body to raise and lower the elevating body.

7. The elevator system according to claim 6, further comprising:

an elevator car which is operatively connected to the hoisting machine, wherein the elevating body is a counter weight.

8. A machine base attachment device, comprising:

a reinforcing body attached to a forming rail that guides movement of an elevating body; and a machine base fixing member, attached to the forming rail, that is fixed to a machine base, the machine base supporting a hoisting machine that generates driving force for moving the elevating body, wherein the forming rail includes a pair of flange portions and a rail projecting portion between the pair of flange portions, a groove portion in the rail projecting portion, the groove portion disposed between the pair of flange portions, the reinforcing body includes an insertion portion that is inserted into the groove portion, the insertion portion attached to the groove portion by a fastener that passes through holes of the rail projection portion and the insertion portion, and the machine base fixing member is attached to a part of the rail projecting portion in which the insertion portion is inserted, wherein:

the machine base fixing member is attached to a side face of the rail projecting portion, fastening insertion holes are disposed in the machine base fixing member, the insertion portion, and the rail projecting portion, and the machine base fixing member, the insertion portion, and the rail projecting portion are fastened together by a fastener in the fastening insertion holes.

* * * * *